US010407637B2

(12) United States Patent
Clark et al.

(10) Patent No.: US 10,407,637 B2
(45) Date of Patent: Sep. 10, 2019

(54) FUEL COMPOSITION

(71) Applicant: SHELL OIL COMPANY, Houston, TX (US)

(72) Inventors: Richard Hugh Clark, Manchester (GB); James Patrick Ewen, Devon (GB); Richard John Heins, Manchester (GB); Paul Anthony Stevenson, Manchester (GB)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/752,953

(22) PCT Filed: Aug. 12, 2016

(86) PCT No.: PCT/EP2016/069258

§ 371 (c)(1),
(2) Date: Feb. 15, 2018

(87) PCT Pub. No.: WO2017/029224

PCT Pub. Date: Feb. 23, 2017

(65) Prior Publication Data

US 2018/0237711 A1 Aug. 23, 2018

(30) Foreign Application Priority Data

Aug. 17, 2015 (EP) ..... 15181308

(51) Int. Cl.

| | |
|---|---|
| ***C10L 10/14*** | (2006.01) |
| ***C10L 1/04*** | (2006.01) |
| ***C10L 1/02*** | (2006.01) |
| ***C10L 1/08*** | (2006.01) |
| *F02M 37/00* | (2006.01) |

(52) U.S. Cl.

CPC ..... *C10L 10/14* (2013.01); *C10L 1/026* (2013.01); *C10L 1/04* (2013.01); *C10L 1/08* (2013.01); *C10G 2300/1022* (2013.01); *C10G 2300/301* (2013.01); *C10G 2300/302* (2013.01); *C10G 2300/304* (2013.01); *C10G 2300/308* (2013.01); *C10G 2400/04* (2013.01); *C10L 2200/043* (2013.01); *C10L 2200/0446* (2013.01); *C10L 2200/0492* (2013.01); *C10L 2270/026* (2013.01); *C10L 2290/24* (2013.01); *F02M 37/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,125,566 | A | 11/1978 | Trin Dinh et al. | |
| 4,208,190 | A | 6/1980 | Malec | |
| 4,478,955 | A | 10/1984 | Pesa et al. | |
| 2007/0205137 | A1 | 9/2007 | Clark et al. | |
| 2009/0165760 | A1* | 7/2009 | Buttery | C10L 1/026 123/575 |
| 2015/0021232 | A1 | 1/2015 | Clark et al. | |

FOREIGN PATENT DOCUMENTS

| | | | |
|---|---|---|---|
| EP | 0147873 | A1 | 7/1985 |
| EP | 0583836 | A1 | 2/1994 |
| GB | 2077289 | A | 12/1981 |

OTHER PUBLICATIONS

International Search Report and Written Opinion received for PCT Patent Application No. PCT/EP2016/069258, dated Nov. 18, 2016, 10 pages.

Van Der Burgt et al., "The Shell Middle Distillate Synthesis Process", 5th Synfuels Worldwide Symposium, Washington, D.C., Nov. 11-13, 1985, 15 pages.

* cited by examiner

*Primary Examiner* — Ellen M McAvoy
*Assistant Examiner* — Chantel L Graham

(57) ABSTRACT

Diesel fuel composition suitable for use in an internal combustion engine comprising: (a) 2 mass % to 30 mass % of kerosene having a kinematic viscosity at 40° C. of 1.5 $mm^2/s$ or less and a density of 810 $kg/m^3$ or less; (b) 2 mass % to 20 mass % of Fischer-Tropsch derived base oil having a kinematic viscosity at 40° C. of 7.5 $mm^2/s$ or greater and a density of 790 $kg/m^3$ or greater; and (c) diesel base fuel. The diesel fuel composition of the present invention provides improved cold flow properties while simultaneously maintaining other properties such as viscosity and density within diesel fuel specification requirements.

11 Claims, No Drawings

FUEL COMPOSITION

PRIORITY CLAIM

The present application is the National Stage (§ 371) of International Application No. PCT/EP2016/069258, filed Aug. 12, 2016, which claims priority from European Patent Application No. 15181308.6, filed Aug. 17, 2015 incorporated herein by reference.

FIELD OF THE INVENTION

The present invention relates to a fuel composition suitable for use in an internal combustion engine, in particular having improved cloud point and improved cold flow properties.

BACKGROUND OF THE INVENTION

Various techniques have been used to improve the cold flow properties of diesel fuel compositions to meet climate-related requirements in diesel fuel specifications.

One way of improving cold flow properties is by the addition of middle distillate flow improver (MDFI) additives. However, the inclusion of such additives can increase the cost of the fuel. In addition, such additives will only affect cold flow properties such as cold filter plugging point (CFPP) and will not contribute to improved cloud point.

Another way of improving cold flow properties, and which also improves cloud point, is by blending conventional diesel fuel with refinery kerosene or Fischer-Tropsch derived kerosene. The addition of kerosene fuel lowers the cloud point of conventional diesel. However, Fischer-Tropsch derived kerosene and refinery kerosene have a low viscosity, typically below the minimum viscosity limit that is required in many diesel specifications. For example, Fischer-Tropsch derived kerosene typically has a viscosity of 1.3 $mm^2/s$ at 40° C. which is below the minimum viscosity limit of 2.0 $mm^2/s$ at 40° C. that is required in many diesel specifications (e.g. EN 590). Unfortunately, the low viscosity of kerosene fuel can limit the amount that can be added before the blend viscosity is reduced below the specification minimum viscosity requirements. In addition, Fischer-Tropsch derived kerosene and refinery kerosene have a low density (typically 810 $kg/m^3$ or less for refinery kerosene and 800 $kg/m^3$ or less for Fischer-Tropsch derived kerosene) which is below the minimum density requirement of 820 $kg/m^3$ in many diesel specifications (e.g. EN 590).

It would be desirable to formulate a diesel fuel composition which enables target cloud point and cold flow properties to be met while ensuring that the final fuel formulation still complies with other specification requirements such as viscosity, density, distillation parameters, and the like.

SUMMARY OF THE INVENTION

According to the present invention there is provided a diesel fuel composition suitable for use in an internal combustion engine comprising:

(a) 2% m/m to 30% m/m of kerosene fuel having a kinematic viscosity at 40° C. of 1.5 $mm^2/s$ or less and a density of 810 $kg/m^3$ or less;

(b) 2% m/m to 20% m/m of Fischer-Tropsch derived base oil having a kinematic viscosity at 40° C. of 7.5 $mm^2/s$ or greater and a density of 790 $kg/m^3$ or greater; and (c) diesel base fuel.

According to the present invention there is further provided a process for preparing a diesel fuel composition wherein the process comprises the steps of:

(i) blending 2% m/m to 30% m/m, based on the total diesel fuel composition, of kerosene fuel, with 2% m/m to 20% m/m, based on the total diesel fuel composition, of Fischer-Tropsch derived base oil to form a kerosene-based fuel blend, wherein the kerosene fuel has a kinematic viscosity at 40° C. of 1.5 $mm^2/s$ or less and a density of 810 $kg/m^3$ or less and wherein the Fischer-Tropsch derived base oil has a kinematic viscosity at 40° C. of 7.5 $mm^2/s$ or greater and a density of 790 $kg/m^3$ or greater; and (ii) blending the kerosene-based fuel blend produced in step (i) with a diesel base fuel to produce a diesel fuel composition.

It has surprisingly been found that the fuel composition of the present invention has improved cloud point and improved cold flow properties, while at the same time complying with other specification requirements such as viscosity, density, distillation properties, and the like.

Hence according to the present invention there is further provided the use of a diesel fuel composition as described herein for providing improved cold flow properties, in particular reduced cold filter plugging point (CFPP), and/or reduced cloud point, in particular while maintaining the density, viscosity and distillation properties of the diesel fuel composition within diesel fuel specifications, especially EN 590.

The fuel compositions to which the present invention relates have use in diesel engines, in particular automotive diesel engines, on road and off road (construction) vehicles, as well as aviation engines, such as aero diesel engines, and marine diesel engines, but also in any other suitable power source. Hence according to the present invention there is further provided a method of operating a diesel engine or a vehicle which is powered by one or more of said engines, which method comprises a step of introducing into said engine a fuel composition according to the present invention.

DETAILED DESCRIPTION OF THE INVENTION

As used herein the term "cloud point" means the temperature below which wax in a diesel fuel composition forms a cloudy appearance. The presence of solidified waxes thickens the oil and clogs fuel filters and injectors in engines. The wax also accumulates on cold surfaces (e.g. pipeline or heat exchanger fouling) and forms an emulsion with water. Therefore, cloud point indicates the tendency of the oil to plug filters or small orifices at cold operating temperatures.

As used herein the term "CFPP" stands for cold filter plugging point and is the lowest temperature, expressed in degrees Celsius (° C.), at which a given volume of diesel type fuel still passes through a standardized filtration device in a specified time when cooled under certain conditions. This test gives an estimate for the lowest temperature that a fuel will give trouble free flow in certain fuel systems. This is important as in cold temperate countries, a high cold filter plugging point will clog up vehicle engines more easily.

As used herein the term "cold flow properties" means those properties of the diesel fuel composition which are measured by CFPP and cloud point as defined above. Therefore an improvement in cold flow properties as used herein means a reduction in CFPP and/or a reduction in cloud point.

The fuel compositions, uses and methods of the present invention may be used to achieve any amount of improvement in cold flow properties. An improvement in cold flow properties may be measured as a reduction in CFPP and/or a reduction in cloud point.

The present invention may be used for the purpose of achieving a desired target level of cloud point or CFPP. The fuel compositions, uses and methods of the present invention preferably achieve a 2° C. reduction or more in the cloud point of the diesel fuel composition, more preferably a 3° C. reduction or more in the cloud point of the diesel fuel composition, even more preferably a 5° C. reduction or more in the cloud point of the diesel fuel composition, and especially a 6° C. reduction or more in the cloud point of the diesel fuel composition, compared with a conventional diesel fuel composition not containing the claimed combination of kerosene fuel and Fischer-Tropsch derived base oil.

The fuel compositions, uses and methods of the present invention preferably achieve a 2° C. reduction or more in the CFPP of the diesel fuel composition, more preferably a 3° C. reduction or more in the CFPP of the diesel fuel composition, even more preferably a 5° C. reduction or more in the CFPP of the diesel fuel composition, and especially a 6° C. reduction or more in the CFPP of the diesel fuel composition, compared with a conventional diesel fuel composition not containing the claimed combination of kerosene fuel and Fischer-Tropsch derived base oil.

The first essential component of the fuel composition of the present invention is a kerosene fuel. The kerosene fuel is present in the fuel composition at a level in the range from 2% m/m to 30% m/m, preferably from 5% m/m to 25% m/m, more preferably from 10% m/m to 25% m/m, of the total fuel composition.

The kerosene fuel for use in the present invention can be derived from any suitable source as long as it is suitable for use in a diesel fuel composition. Suitable kerosene fuels include, for example, conventional petroleum-derived, (refinery) kerosene fuel and Fischer-Tropsch derived kerosene fuel, and mixtures thereof. From the viewpoint of providing improved cold flow properties, in particular, and improved CFPP and/or improved cloud point properties, while ensuring other properties such as viscosity, density and distillation properties stay within the requirements of diesel specifications, the kerosene fuel used herein is preferably a Fischer-Tropsch derived kerosene fuel.

The Fischer-Tropsch derived kerosene should be suitable for use as a kerosene fuel. Its components (or the majority, for instance 95% w of greater, thereof) should therefore have boiling points within the typical kerosene fuel range, i.e. from 130 to 300° C.

The petroleum-derived and Fischer-Tropsch derived kerosene fuel used in the present invention have a kinematic viscosity at 40° C. (as measured according to EN ISO 3104) of 1.5 $mm^2/s$ or less, preferably in the range from 0.7 $mm^2/s$ to 1.5 $mm^2/s$, more preferably in the range from 1.0 $mm^2/s$ to 1.3 $mm^2/s$.

The Fischer-Tropsch derived kerosene fuel used in the present invention preferably has a density (as measured according to EN ISO 12185, at a temperature of 15° C.) of 760 $kg/m^3$ or less, preferably in the range from 710 $kg/m^3$ to 760 $kg/m^3$, more preferably from 730 $kg/m^3$ to 760 $kg/m^3$ at 15° C.

The petroleum-derived kerosene fuel used in the present invention preferably has a density of 810 $kg/m^3$ or less (as measured according to EN ISO 12185, at a temperature of 15° C.) preferably in the range of from 770 $kg/m^3$ to 810 $kg/m^3$, more preferably from 790 $kg/m^3$ to 810 $kg/m^3$.

A second essential component of the fuel compositions herein is a Fischer-Tropsch derived base oil. According to the invention, the amount of Fischer-Tropsch derived base oil is in the range from 2% up to 30% m/m of the total composition, preferably in the range from 5% to 25% m/m of the total composition, more preferably in the range from 10% to 20% m/m of the total composition.

The Fischer-Tropsch derived base oil used in the present invention will typically have a density (as measured by EN ISO 12185 of 0.79 $g/cm^3$ or greater, preferably from 0.79 to 0.82, preferably 0.800 to 0.815, and more preferably 0.805 to 0.810 $g/cm^3$ at 15° C.; a kinematic viscosity (EN ISO 3104) of 7.5 $mm^2/s$ or greater, preferably from 7.5 to 12.0, preferably 8.0 to 11.0, more preferably from 9.0 to 10.5, $mm^2/s$ at 40° C.

The total amount of kerosene and Fischer-Tropsch derived base oil together is at least 4% m/m and at most 50% m/m of the total composition, preferably in the range from 10% m/m to 40% m/m of the total composition, more preferably in the range from 15% m/m to 35% m/m of the total composition, even more preferably in the range from 20% m/m to 30% m/m of the total composition.

The paraffinic nature of the Fischer-Tropsch derived components in the present invention (kerosene and base oil) mean that the fuel compositions of the present inventions will have high cetane numbers compared to conventional diesel.

In accordance with the presence invention, the Fischer-Tropsch derived components used herein, (i.e. the Fischer-Tropsch derived gasoil, base oil or kerosene) will preferably consist of at least 95% w/w, more preferably at least 98% w/w, even more preferably at least 99.5% w/w, and most preferably up to 100% w/w of paraffinic components, preferably iso- and normal paraffins.

In accordance with the present invention the weight ratio of iso-paraffins to normal paraffins of the Fischer-Tropsch derived gasoil and Fischer-Tropsch kerosene is suitably from 0.3 up to 12, in particular from 2 to 6.

In accordance with the present invention the weight ratio of iso-paraffins to normal paraffins of the Fischer-Tropsch derived base oil is suitably greater than 100.

In accordance with the present invention, the Fischer-Tropsch derived components used herein (i.e. the Fischer-Tropsch derived gasoil, base oil or kerosene) will preferably comprise no more than 3% w/w, more preferably no more than 2% w/w, even more preferably no more than 1% w/w of cycloparaffins (naphthenes), by weight of the Fischer-Tropsch derived component.

The Fischer-Tropsch derived components used herein (i.e. the Fischer-Tropsch derived gasoil, base oil or kerosene) preferably comprise no more than 1% w/w, more preferably no more than 0.5% w/w, of olefins, by weight of the Fischer-Tropsch derived component.

Fuel compositions of the present invention are particularly suitable for use as a diesel fuel, and can be used for arctic applications, as winter grade diesel fuel due to the excellent cold flow properties.

Accordingly, a further embodiment of the invention relates to the use of fuel compositions according to the present invention as fuel in a direct or indirect injection diesel engine, in particular in conditions requiring a fuel with good cold flow properties.

For example, a cloud point of −10° C. or lower (EN 23015) or a cold filter plugging point (CFPP) of −20° C. or lower (as measured by EN 116) may be possible with fuel compositions according to the present invention. Both Fischer-Tropsch derived base oil and Fischer-Tropsch derived kerosene fuel can have a lower inherent CFPP than the diesel base fuel. This means that the proposed formulation will be expected to have improved cold flow performance over the diesel base fuel, enabling the formulation to be used as winter grade fuel, or in the case of forming a formulation with a base diesel with better cold flow, even an arctic grade could be achieved.

The diesel base fuel may be any petroleum derived diesel suitable for use in an internal combustion engine, such as a petroleum derived low sulphur diesel comprising <50 ppm of sulphur, for example, an ultra low sulphur diesel (ULSD) or a zero sulphur diesel (ZSD). Preferably, the low sulphur diesel comprises <10 ppm of sulphur.

The petroleum derived low sulphur diesel preferred for use in the present invention will typically have a density from 0.81 to 0.865, preferably 0.82 to 0.85, more preferably 0.825 to 0.845 g/cm$^3$ at 15° C.; a cetane number (ASTM D613) at least 51; and a kinematic viscosity (ASTM D445) from 1.5 to 4.5, preferably 2.0 to 4.0, more preferably from 2.2 to 3.7 mm$^2$/s at 40° C.

In one embodiment the diesel base fuel is a Fischer-Tropsch derived gas oil. In another embodiment, the diesel base fuel is a blend of conventional petroleum-derived diesel and Fischer-Tropsch derived gas oil.

By "Fischer-Tropsch derived" is meant that a fuel or base oil is, or derives from, a synthesis product of a Fischer-Tropsch condensation process. The term "non-Fischer-Tropsch derived" may be interpreted accordingly. A Fischer-Tropsch derived fuel or base oil may also be referred to as a GTL (gas-to-liquid) fuel or base oil, respectively.

The Fischer-Tropsch reaction converts carbon monoxide and hydrogen into longer chain, usually paraffinic, hydrocarbons:

$n(CO+2H_2)=(—CH_2—)_n+nH_2O+$heat, in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen: carbon monoxide ratios other than 2:1 may be employed if desired.

The carbon monoxide and hydrogen may themselves be derived from organic or inorganic, natural or synthetic sources, typically either from natural gas or from organically derived methane.

Gas oil, kerosene fuel and base oil products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e. g. GB2077289 and EP0147873) and/or hydroisomerisation which can improve cold flow properties by increasing the proportion of branched paraffins. EP0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel or oil. Desired diesel fuel fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP0583836.

An example of a Fischer-Tropsch based process is the SMDS (Shell Middle Distillate Synthesis) described in "The Shell Middle Distillate Synthesis Process", van der Burgt et al (vide supra). This process (also sometimes referred to as the Shell "Gas-to-Liquids" or "GTL" technology) produces diesel range products by conversion of a natural gas (primarily methane) derived synthesis gas into a heavy long-chain hydrocarbon (paraffin) wax which can then be hydroconverted and fractionated to produce liquid transport fuels such as gasoils and kerosene. Versions of the SMDS process, utilising fixed-bed reactors for the catalytic conversion step, are currently in use in Bintulu, Malaysia, and in Pearl GTL, Ras Laffan, Qatar. Kerosenes and (gas)oils prepared by the SMDS process are commercially available for instance from the Royal Dutch/Shell Group of Companies.

By virtue of the Fischer-Tropsch process, a Fischer-Tropsch derived fuel or base oil has essentially no, or undetectable levels of, sulphur and nitrogen. Compounds containing these heteroatoms tend to act as poisons for Fischer-Tropsch catalysts and are therefore removed from the synthesis gas feed. Further, the process as usually operated produces no or virtually no aromatic components.

For example, the aromatics content of a Fischer-Tropsch gasoil, as determined for instance by ASTM D4629, will typically be below 1% w/w, preferably below 0.5% w/w and more preferably below 0.1% w/w. The aromatics content of a Fischer-Tropsch derived base oil will also typically be below 1% w/w, preferably below 0.5% w/w and more preferably below 0.1% w/w.

Generally speaking, Fischer-Tropsch derived fuels have relatively low levels of polar components, in particular polar surfactants, for instance compared to petroleum derived fuels. It is believed that this can contribute to improved antifoaming and dehazing performance. Such polar components may include for example oxygenates, and sulphur and nitrogen containing compounds. A low level of sulphur in a Fischer-Tropsch derived fuel is generally indicative of low levels of both oxygenates and nitrogen-containing compounds, since all are removed by the same treatment processes.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically 190 to 260° C., for instance from 190 to 210° C. for a typical "narrow cut" kerosene fraction or from 240 to 260° C. for a typical full cut fraction. Its initial boiling point is preferably from 140 to 160° C., more preferably 145 to 160° C. Again, Fischer-Tropsch derived fuels tend to be low in undesirable fuel components such as sulphur, nitrogen and aromatics.

The Fischer-Tropsch derived kerosene fuel used in the present invention will preferably have a density (as measured by EN ISO 12185 of from 0.730 to 0.760 g/cm at −15° C. It preferably has a sulphur content (ASTM D2622) of 5 ppmw (parts per million by weight) or less. It preferably has a cetane number of from 63 to 75, for example from 65 to 69 for a narrow-cut fraction, and from 68 to 73 for a full cut fraction. It is preferably the product of an SMDS process, preferred features of which may be as described below in connection with Fischer-Tropsch derived gas oils. The Fischer Tropsch kerosene used herein preferably has a kinematic viscosity at 40° C. (as measured according to EN ISO 3104) of 1.5 $mm^2/s$ or less, preferably in the range of from 0.7 $mm^2/s$ to 1.5 $mm^2/s$, more preferably in the range from 1.0 $mm^2/s$ to 1.3 $mm^2/s$.

The Fischer-Tropsch derived kerosene fuel as used in the present invention is that produced as a distinct finished product, that is suitable for sale and used in applications that require the particular characteristics of a kerosene fuel. In particular, it exhibits a distillation range falling within the range normally relating to Fischer-Tropsch derived kerosene fuels, as set out above.

A fuel composition according to the present invention may include a mixture of two or more Fisher-Tropsch derived kerosene fuels.

Preferably the Fischer-Tropsch derived base oil used in the present invention is a product prepared by a Fischer-Tropsch methane condensation reaction using a hydrogen/carbon monoxide ratio of less than 2.5, preferably less than 1.75, more preferably from 0.4 to 1.5.

The Fischer-Tropsch derived base oil used in the present invention will typically have a density of 0.79 g/cm or greater, preferably from 0.79 to 0.82, preferably 0.800 to 0.815, and more preferably 0.805 to 0.810 $g/cm^3$ at 15° C.; a kinematic viscosity (EN ISO 3104) of 7.5 $mm^2/s$ or greater, preferably from 7.5 to 12.0, preferably 8.0 to 11.0, more preferably from 9.0 to 10.5, $mm^2/s$ at 40° C.; and a sulphur content (ASTM D2622) of 5 ppmw (parts per million by weight) or less, preferably of 2 ppmw or less.

Generally speaking, in the context of the present invention the fuel composition may be additivated with fuel additives. Unless otherwise stated, the (active matter) concentration of each such additive in a fuel composition is preferably up to 10000 ppmw, more preferably in the range from 5 to 1000 ppmw, advantageously from 75 to 300 ppmw, such as from 95 to 150 ppmw. Such additives may be added at various stages during the production of a fuel composition; those added to a base fuel at the refinery for example might be selected from anti-static agents, pipeline drag reducers, middle distillate flow improvers (MDFI) (e.g., ethylene/vinyl acetate copolymers or acrylate/maleic anhydride copolymers), lubricity enhancers, anti-oxidants and wax anti-settling agents.

An advantage of the fuel composition of the present invention is that cold flow properties are improved thus reducing the need for MDFI additives. In a conventional diesel fuel composition, MDFI are typically present at a level of 500 ppm or less, preferably in the range from 50 ppm to 500 ppm, more preferably in the range from 100 ppm to 300 ppm, of the total composition. In the diesel fuel compositions of the present invention, MDFI additives can be used at the same level as are typically present in a conventional diesel fuel composition. However, in preferred embodiments of the present invention, the fuel composition comprises reduced levels of MDFI additives than are present in a conventional diesel fuel composition. In one embodiment of the present invention, the fuel composition comprises MDFI additives at a level of 100 ppm or less, preferably at a level of 50 ppm or less. In a preferred embodiment of the present invention, the fuel composition is essentially free of MDFI additives. In another preferred embodiment of the present invention, the fuel composition is free (i.e. contains 0 ppm) of MDFI additives.

The fuel composition may include a detergent, by which is meant an agent (suitably a surfactant) which can act to remove, and/or to prevent the build-up of, combustion related deposits within an engine, in particular in the fuel injection system such as in the injector nozzles. Such materials are sometimes referred to as dispersant additives. Where the fuel composition includes a detergent, preferred concentrations are in the range 20 to 500 ppmw active matter detergent based on the overall fuel composition, more preferably 40 to 500 ppmw, most preferably 40 to 300 ppmw or 100 to 300 ppmw or 150 to 300 ppmw. Detergent-containing diesel fuel additives are known and commercially available. Examples of suitable detergent additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Particularly preferred are polyolefin substituted succinimides such as polyisobutylene succinimides.

Other components which may be incorporated as fuel additives, for instance in combination with a detergent, include lubricity enhancers; dehazers, e.g. alkoxylated phenol formaldehyde polymers; anti-foaming agents (e.g. commercially available polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; and mixtures thereof.

It is preferred that the additive contain an anti-foaming agent, more preferably in combination with an anti-rust agent and/or a corrosion inhibitor and/or a lubricity additive.

It is particularly preferred that a lubricity enhancer be included in the fuel composition, especially when it has a low (e.g. 500 ppmw or less) sulfur content. The lubricity enhancer is conveniently present at a concentration from 50 to 1000 ppmw, preferably from 100 to 1000 ppmw, based on the overall fuel composition.

The (active matter) concentration of any dehazer in the fuel composition will preferably be in the range from 1 to 20 ppmw, more preferably from 1 to 15 ppmw, still more preferably from 1 to 10 ppmw and advantageously from 1 to 5 ppmw. The (active matter) concentration of any ignition improver present will preferably be 600 ppmw or less, more preferably 500 ppmw or less, conveniently from 300 to 500 ppmw.

The present invention may in particular be applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy- and/or light-duty diesel engines.

In order to be suitable for at least the above uses, the diesel fuel composition of the present invention preferably has one or more of the following characteristics:

a kinematic viscosity at 40° C. of 1.9 $mm^2/s$ or greater, more preferably in the range from 1.9 to 4.5 $mm^2/s$;

- a density of 800 kg/m$^3$ or greater, more preferably in the range from 800 to 860, even more preferably 800 to 845 kg/m$^3$;
- a T95 of 360° C. or less;
- a cloud point in the range from 0° C. to −13° C., more preferably from −5° C. to −8° C.;
- a CFPP in the range of from −8° C. to −30° C., more preferably from −15° C. to −20° C.

The invention is illustrated by the following non-limiting examples.

EXAMPLES

A number of fuel blends were produced having the compositions shown in Table 2 below. Table 1 shows the physical characteristics of the GTL kerosene and the GTL base oil (GTL BO3) used in the blends. The GTL kerosene and the GTL base oil (GTL BO3) were both obtained from Pearl GTL, Ras Laffan and are commercially available from the Shell/Royal Dutch Group of Companies. The physical characteristics of the conventional diesel fuel (Diesel BO) used in the blends is shown in Table 2. As used herein "Diesel BO" means diesel base fuel containing 0% biofuel components.

Various measurements of the final blends were taken using the test methods set out in Table 2, including density, viscosity, cloud point and CFPP measurements.

TABLE 1

| | | | Neat Components Sample Name: | |
|---|---|---|---|---|
| | | | GTL Kerosene | GTL BO3 |
| | | | Composition: | |
| | unit | method | Pearl GTL Kerosene | Pearl GTL BO3 |
| Density | Kg/m$^3$ | EN ISO 12185 | 753.5 | 808 |
| Viscosity @ 40° C. | mm$^2$/s | EN ISO 3104 | 1.265 | 9.869 |
| Cloud Point | ° C. | EN 23015 | <−40 | −31 |
| CFPP | ° C. | EN 116 | <−51 | NA* |
| Distillation | | EN ISO 3405 | | ** |
| IBP | ° C. | | 164.9 | 314.5 |
| T5 | ° C. | | 177 | 351.5 |
| T10 | ° C. | | 180.6 | 359.5 |
| T20 | ° C. | | 186.2 | 367 |
| T30 | ° C. | | 191.3 | 372.5 |
| T40 | ° C. | | 195.5 | 377.5 |
| T50 | ° C. | | 200.2 | 381.5 |
| T60 | ° C. | | 205.2 | 385 |
| T70 | ° C. | | 210.4 | 389 |
| T80 | ° C. | | 216.3 | 393.5 |
| T90 | ° C. | | 224.1 | 401 |
| T95 | ° C. | | 230.6 | 415 |
| FBP | ° C. | | 238 | 533 |
| E250 | % v/v | | 100 | 0 |
| E350 | % v/v | | 100 | 4 |

*The viscosity of GTL BO3 is outside the scope of the CFPP test.

** For GTL BO3, distillation data is from Simulated Distillation (GC) and not EN ISO 3405.

TABLE 2

| | | | Diesel Base Fuel | GTL kerosene blends | | Blends with GTL kerosene and GTL BO3 | | | |
|---|---|---|---|---|---|---|---|---|---|
| | | | Sample Name: | | | | | | |
| | | | Diesel B0 | Blend 1 | Blend 2 | Blend 3 | Blend 4 | Blend 5 | Blend 6 |
| | | | Composition: | | | | | | |
| | unit | method | Conventional Diesel B0 | 80% m/m Diesel B0 + 20% m/m GTL kero | 70% m/m Diesel B0 + 20% m/m GTL kero | 80% m/m Diesel B0 + 13.33% m/m GTL kero + 6.66% m/m GTL BO3 | 80% m/m Diesel B0 + 10% m/m GTL kero + 6.66% m/m GTL BO3 | 70% m/m Diesel B0 + 20% m/m GTL kero + 10% m/m GTL BO3 | 70% m/m Diesel B0 + 15% m/m GTL kero + 15% m/m GTL BO3 |
| Density | kg/m$^3$ | EN ISO 12185 | 843.1 | 823.7 | 814.3 | 827.7 | 829.7 | 820.2 | 823.2 |
| Viscosity @ 40° C. | mm/s$^2$ | EN ISO 3104 | 2.571 | 2.149 | 1.989 | 2.461 | 2.630 | 2.402 | 2.665 |
| Cloud Point | ° C. | EN 23015 | −4.6 | −7.7 | −9.0 | −6.9 | −7.2 | −8.4 | −8.0 |
| CFPP | ° C. | EN 116 | −16 | −19 | −19 | −20 | −19 | −15 | −17 |
| Distillation | | EN ISO 3405 | | | | | | | |
| IBP | ° C. | | 159.1 | 158.3 | 159.9 | 156.5 | 159.7 | 161.5 | 162.3 |
| T5 | ° C. | | 179.4 | 178.5 | 177.7 | 179.1 | 177.1 | 179.5 | 179.5 |
| T10 | ° C. | | 190.2 | 185.6 | 184.1 | 187.9 | 187.3 | 187.3 | 188.9 |

TABLE 2-continued

| | | | Diesel Base Fuel | GTL kerosene blends | | Blends with GTL kerosene and GTL BO3 | | | |
|---|---|---|---|---|---|---|---|---|---|
| | | | Sample Name: | | | | | | |
| | | | Diesel B0 | Blend 1 | Blend 2 | Blend 3 | Blend 4 | Blend 5 | Blend 6 |
| | | | Composition: | | | | | | |
| | unit | method | Conventional Diesel B0 | 80% m/m Diesel B0 + 20% m/m GTL kero | 70% m/m Diesel B0 + 20% m/m GTL kero | 80% m/m Diesel B0 + 13.33% m/m GTL kero + 6.66% m/m GTL BO3 | 80% m/m Diesel B0 + 10% m/m GTL kero + 6.66% m/m GTL BO3 | 70% m/m Diesel B0 + 20% m/m GTL kero + 10% m/m GTL BO3 | 70% m/m Diesel B0 + 15% m/m GTL kero + 15% m/m GTL BO3 |
| T20 | ° C. | | 211.1 | 199.7 | 195.9 | 204.5 | 205.1 | 201.6 | 205.4 |
| T30 | ° C. | | 235.5 | 214.4 | 207.7 | 223.5 | 226.8 | 218.6 | 225.8 |
| T40 | ° C. | | 256.6 | 230.8 | 221.4 | 243.1 | 249.7 | 236.8 | 248.0 |
| T50 | ° C. | | 273.7 | 249.5 | 236.8 | 264.5 | 271.7 | 258.8 | 271.8 |
| T60 | ° C. | | 288.6 | 269.5 | 254.3 | 285.3 | 292.6 | 282.8 | 295.8 |
| T70 | ° C. | | 302.2 | 289.8 | 277.6 | 304.9 | 311.3 | 305.8 | 317.1 |
| T80 | ° C. | | 316.9 | 308.8 | 301.1 | 323.3 | 329.7 | 327.1 | 336.2 |
| T90 | ° C. | | 336.6 | 331.1 | 324.5 | 344.8 | 349.6 | 348.5 | 353.3 |
| T95 | ° C. | | 352.4 | 348.4 | 340.4 | 357.9 | 361.0 | 359.7 | 362.3 |
| FBP | ° C. | | 363.7 | 359.9 | 353.2 | 366.8 | 369.1 | 367.8 | 366.7 |
| E250 | % v/v | | 36.6 | 50.3 | 57.9 | 43.0 | 40.1 | 46.4 | 40.9 |
| E350 | % v/v | | 94.4 | 95.3 | 97.0 | 92.2 | 90.2 | 90.8 | 88.0 |

DISCUSSION

Example 1

As can be seen from Table 2, to lower the cloud point of Diesel BO, 20% of GTL kerosene is added (Blend 1). This lowers the Cloud Point from −4.6° C. to −7.7° C. However density has also been lowered to 823.7 kg/m$^3$ and the viscosity lowered to 2.149 mm/s$^2$. These are close to the EN 590 specification minimum requirements of 820 kg/m$^3$ for density and 2 mm/s$^2$ for viscosity. If further addition of GTL kerosene is required to lower the Cloud Point further, density and viscosity of the blend decrease further and fall below the minimum specification requirements—see Blend 2 which contains 30% GTL kerosene. If instead of adding 30% GTL kerosene, 10% GTL BO3 plus 20% GTL kerosene is added (Blend 5), a lower Cloud Point is obtained than Blend 1 (−8.4° C. v −7.7° C.) but density and viscosity remain above the minimum specification requirements.

Example 2

As can be seen from Table 2, to lower the Cloud Point of Diesel BO, 20% kerosene is added (Blend 1). This lowers the Cloud Point from −4.6° C. to −7.7° C. However density has also been lowered to 823.7 kg/m$^3$ and viscosity lowered to 2.149 mm/s$^2$. These are close to the specification minimum requirements of 820 kg/m$^3$ for density and 2 mm/s$^2$ for viscosity. If instead of adding 20% GTL kerosene, 13.33% GTL kerosene plus 6.66% GTL BO3 is added (Blend 3) similar reductions in Cloud Point and CFPP are still obtained but viscosity is significantly higher which can provide power benefits in diesel engines.

The present invention has the key advantage that it allows for an improvement in Cloud Point and CFPP properties while simultaneously maintaining other properties such as viscosity and density within diesel fuel specification requirements (e.g. EN590).

That which is claimed is:

1. A diesel fuel composition suitable for use in an internal combustion engine comprising:

(a) 2 mass % to 30 mass % of Fischer-Tropsch derived kerosene having a kinematic viscosity at 40° C. of 1.5 mm$^2$/s or less and a density of 810 kg/m$^3$ or less, wherein the Fischer-Tropsch derived kerosene consists of at least 95% w/w of paraffinic components, and wherein the Fischer-Tropsch derived kerosene comprises no more than 3% w/w of cycloparaffins and no more than 1% w/w of olefins, by weight of the Fischer-Tropsch derived kerosene;

(b) 2 mass % to 20 mass % of Fischer-Tropsch derived base oil having a kinematic viscosity at 40° C. of 7.5 mm$^2$/s or greater and a density of 790 kg/m$^3$ or greater, wherein the Fischer-Tropsch derived base oil consists of at least 95% w/w of paraffinic components, and wherein the Fischer-Tropsch derived base oil comprises no more than 3% w/w of cycloparaffins and no more than 1% w/w of olefins, by weight of the Fischer-Tropsch derived base oil; and (c) diesel base fuel.

2. The diesel fuel composition according to claim 1 having a kinematic viscosity at 40° C. of 1.9 mm$^2$/s or greater.

3. The diesel fuel composition according to claim 1 having a density of 800 kg/m$^3$ or greater.

4. The diesel fuel composition according to claim 1 having a T95 of 360° C. or less.

5. The diesel fuel composition according to claim 1 having a cloud point in the range from 0° C. to −13° C.

6. The diesel fuel composition according to claim 1 having a CFPP in the range of from −8° C. to −30° C.

7. The diesel fuel composition according to claim 1 wherein the diesel fuel composition comprises 100 ppm or less of middle distillate flow improver additives.

8. The diesel fuel composition according to claim 1 wherein the diesel fuel composition is free of middle distillate flow improver additives.

9. A process for preparing a diesel fuel composition wherein the process comprises the steps of:

(i) blending 2 mass % to 30 mass %, by mass of the diesel fuel composition, of Fischer-Tropsch derived kerosene, with 2 mass % to 20 mass %, by mass of the diesel fuel composition, of Fischer-Tropsch derived base oil to form a kerosene-based fuel blend, wherein the Fischer-Tropsch derived kerosene has a kinematic viscosity at 40° C. of 1.5 $mm^2/s$ or less and a density of 810 $kg/m^3$ or less, wherein the Fischer-Tropsch derived kerosene consists of at least 95% w/w of paraffinic components and wherein the Fischer-Tropsch derived kerosene comprises no more than 1% w/w of cycloparaffins and no more than 1% w/w of olefins, by weight of the Fischer-Tropsch derived kerosene, and wherein the Fischer-Tropsch derived base oil has a kinematic viscosity at 40° C. of 7.5 $mm^2/s$ or greater and a density of 790 $kg/m^3$ or greater, wherein the Fischer-Tropsch derived base oil consists of at least 95% w/w of paraffinic components, and wherein the Fischer-Tropsch derived base oil comprises no more than 1% w/w of cycloparaffins and no more than 1% w/w of olefins, by weight of the Fischer-Tropsch derived base oil; and (ii) blending the kerosene-based fuel blend produced in step (i) with a diesel base fuel to produce a diesel fuel composition.

10. The diesel fuel composition prepared according to the process of claim 9.

11. A method of operating a diesel engine or a vehicle which is powered by one or more of said engines, which method comprises a step of introducing into said engine a fuel composition according to claim 1.

* * * * *